US008212476B2

(12) United States Patent
Auer et al.

(10) Patent No.: US 8,212,476 B2
(45) Date of Patent: Jul. 3, 2012

(54) WELDING AID FOR A SPIRAL-WOUND FILAMENT

(75) Inventors: Frank Auer, Herbrechtingen-Bolheim (DE); Gerhard Behr, Altheim (DE); Peter Helbig, Sontheim/Brenz (DE); Christian Seichter, Herbrechtingen (DE); Klaus Wittmann, Sontheim (DE); Sascha Zelt, Beimerstetten (DE)

(73) Assignee: Osram AG, Munich (DE)

( * ) Notice: Subject to any disclaimer, the term of this patent is extended or adjusted under 35 U.S.C. 154(b) by 162 days.

(21) Appl. No.: 12/312,624

(22) PCT Filed: Dec. 5, 2007

(86) PCT No.: PCT/EP2007/063360

§ 371 (c)(1), (2), (4) Date: Dec. 8, 2009

(87) PCT Pub. No.: WO2008/074638

PCT Pub. Date: Jun. 26, 2008

(65) Prior Publication Data

US 2010/0320900 A1 Dec. 23, 2010

(30) Foreign Application Priority Data

Dec. 19, 2006 (DE) ..... 10 2006 060 025

(51) Int. Cl.

| | |
|---|---|
| ***H01K 1/50*** | (2006.01) |
| ***H01K 3/00*** | (2006.01) |
| ***H01K 1/00*** | (2006.01) |

(52) U.S. Cl. ..... 313/579; 313/315; 445/66

(58) Field of Classification Search ..... 313/627–643, 313/567, 25, 26.3, 318.01–318.12, 315, 579; 438/226

See application file for complete search history.

(56) References Cited

U.S. PATENT DOCUMENTS

| | | | | |
|---|---|---|---|---|
| 4,683,397 | A * | 7/1987 | Johnson, Jr. | 313/344 |
| 5,808,399 | A | 9/1998 | Yoneyama | |
| 6,879,102 | B2 * | 4/2005 | Wittmann et al. | 313/578 |
| 7,375,367 | B2 | 5/2008 | Hooper et al. | |
| 2002/0135302 | A1 | 9/2002 | Sakai et al. | |
| 2003/0142495 | A1 | 7/2003 | Nakao | |
| 2005/0073252 | A1 | 4/2005 | Ohashi et al. | |
| 2005/0128763 | A1 * | 6/2005 | Seichter et al. | 362/509 |
| 2005/0162091 | A1 | 7/2005 | Seichter et al. | |

FOREIGN PATENT DOCUMENTS

| | | |
|---|---|---|
| EA | 1 564 789 A3 | 8/2005 |
| EP | 1 564 789 A2 | 8/2005 |
| EP | 1 564 789 B1 | 8/2005 |

* cited by examiner

*Primary Examiner* — Tracie Y Green
(74) *Attorney, Agent, or Firm* — Holtz, Holtz, Goodman & Chick, PC

(57) ABSTRACT

Disclosed are a welding aid for a spiral-wound filament of a lamp and a lamp comprising such a welding aid. The spiral-wound filament has a spiral-wound filament body and at least one spiral-wound filament tail. The welding aid is arranged at a distance d from the spiral-wound filament body and is designed to connect the at least one spiral-wound filament tail to a current-conducting support, the distance d being defined in accordance with a power P at which the lamp is operated.

12 Claims, 1 Drawing Sheet

WELDING AID FOR A SPIRAL-WOUND FILAMENT

This application is a U.S. National Phase Application under 35 USC 371 of International Application PCT/EP2007/063360, filed Dec. 5, 2007, which is incorporated herein in its entirety by this reference.

TECHNICAL FIELD

The present invention relates to a welding aid for an incandescent filament of a lamp, to a lamp with such a welding aid, and to a method for attaching such a welding aid, the welding aid being designed to connect the incandescent filament to a current-conducting mount.

PRIOR ART

In general, the connection between an incandescent filament and a power supply line is produced by means of welding. For this purpose, so-called welding aids are used which usually consist of molybdenum and ensure that there is a fixed connection between the incandescent filament and the power supply line.

In this case, as is described in the document U.S. Pat. No. 5,808,399, for example, a molybdenum foil is positioned around the end of the incandescent filament which is intended to be connected to the power supply line, with it being necessary for the molybdenum foil to have a certain distance d from the actual incandescent filament body in order not to damage the incandescent filament by means of the welding process. In addition, as is described in this document, the molybdenum foil can be aligned in such a way that a rotation of the incandescent filament during welding is prevented. However, instead of a foil, it is also possible for a molybdenum tube or a molybdenum strip to be positioned around the incandescent filament wire.

One disadvantage with the use of welding aids, however, is the fact that the temperature of the first 1-3 turns of the incandescent filaments is reduced owing to the additional thermal capacities of the welding aid. As a result, a temperature gradient is formed over the length of the incandescent filament, with the temperature dropping towards the ends of the incandescent filament. This results in a reduced or inhomogeneous luminance, which in turn results in a non-optimal light distribution in the lamp, in particular in the headlamp. Furthermore, the tungsten transfer from the filament center to the filament ends is increased, which can result in turn-to-turn short circuits and ultimately in a reduced life of the lamp.

DESCRIPTION OF THE INVENTION

The object of the present invention is therefore to provide a welding aid and a lamp with such a welding aid and a method for attaching such a welding aid which improves the abovementioned disadvantages of the prior art.

This object is achieved by a welding aid, as well as a lamp with such a welding aid and a method for attaching such a welding aid, wherein the welding aid is designed to connect an incandescent filament end to a current-conducting mount, and said welding aid is arranged at a certain distance d from the incandescent filament body, the distance d being fixed depending on a power P at which the lamp is operated.

Owing to this power-dependent scaling of the distance d between the welding aid and the incandescent filament body, it is firstly possible to minimize the distance d in the case of lamps with low wattages, as a result of which the component size can overall be reduced. Secondly, the optimized distance d makes it possible to reduce the temperature withdrawal, as a result of which the temperature gradient can be markedly reduced.

In the case of the welding aids known from the prior art, the distance between the welding aid and the incandescent filament body has primarily been determined by the predetermined geometry of the incandescent filament and the current-carrying mount. The other boundary condition which needs to be met was naturally that the welding aid should not be arranged too close to the incandescent filament body.

For an improved temperature gradient and therefore a more optimum light distribution in the lamp, according to the invention the distance d is scaled with the power P. In particular a scaling of $$0.018 \leq \frac{d}{P} \leq 0.06 \frac{\text{mm}}{W}$$

has proven to be particularly advantageous. Such a scaling results in a very low temperature gradient and therefore brings about a homogeneous luminance, which in turn results in an improved light distribution in the headlamp. For example, it is thus possible to ensure a defined light/dark boundary if the lamp is intended to be used as a headlamp for the lower beam.

Particularly advantageous is an exemplary embodiment in which the scaling ratio of the distance to the power is $$\frac{d}{P} = 0.022 \frac{\text{mm}}{W},$$

which results in a distance of d=0.4 mm given a power of a halogen lamp for headlamps of 18 W.

Advantageously, owing to the distance between the welding aid and the incandescent filament body which is scaled with the electrical power of the incandescent filament, the temperature gradient is reduced, and the luminance and the light distribution improved, as a result of which a longer life of the lamp is also achieved.

Further advantages and advantageous exemplary embodiments are defined in the dependent claims, the drawings and the description.

BRIEF DESCRIPTION OF THE DRAWINGS

The invention will be described in more detail below with reference to exemplary embodiments illustrated in the figures, in which.

PREFERRED EMBODIMENT OF THE INVENTION

Identical or similar elements have been denoted by the same reference symbols below.

Figure 1:
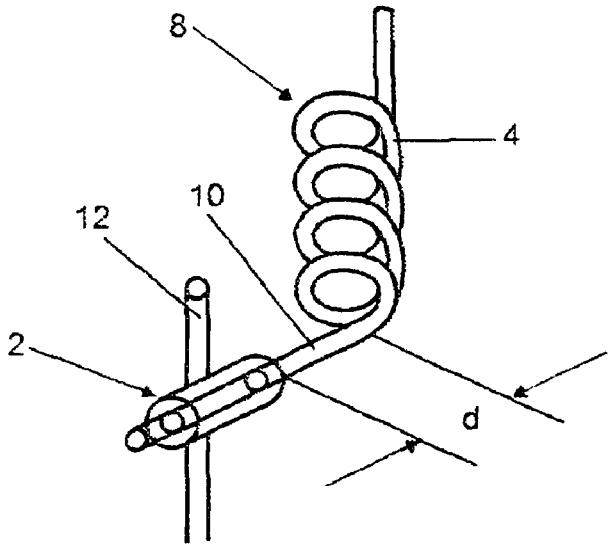
FIG. 1 shows a perspective detail view of a first exemplary embodiment according to the invention.

FIG. 1 shows a perspective detail view of a first exemplary embodiment of the present invention, in which a welding aid 2 is arranged at a certain distance d from a filament body 4 of an incandescent filament 8. The welding aid 2 can consist, for example, of a molybdenum strip, a molybdenum tube or else of a molybdenum foil, which is arranged around an incandescent filament end 10 of the incandescent filament 8 in order to connect the incandescent filament end 10 to a current-conducting mount 12. In this case, the distance d is determined via a power P at which the incandescent filament 8 is intended to be operated, wherein this scalina is fixed by means of the relationship $$0.018 \leq \frac{d}{P} \leq 0.06.$$

Particularly advantageous is a ratio of $$\frac{d}{P} \approx 0.022 \frac{\text{mm}}{W}.$$

This means, for example, that if the incandescent filament 8 is intended to be operated at a power of P=18 W, the distance is d=0.4 mm.

Figure 2A:
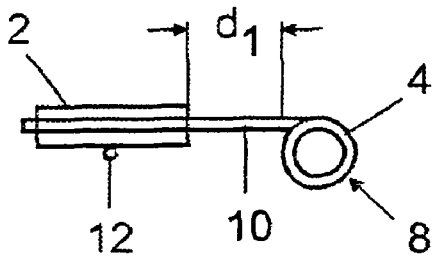
FIG. 2A shows a plan view of the exemplary embodiment illustrated in FIG. 1, with a power $P_1$ being used.
Figure 2B:
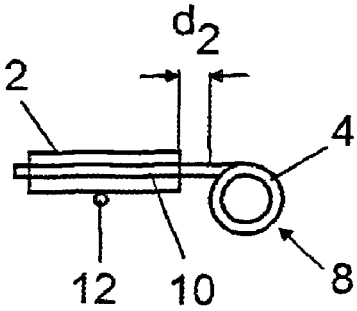
FIG. 2B shows a plan view of the exemplary embodiment illustrated in FIG. 1, with a power $P_2$ being used.

FIGS. 2A and 2B show the change in the distance d if the incandescent filament 8 is intended to be operated at different powers $P_1$ and $P_2$, respectively.

In this case, there is the rule of thumb that a higher power requires a greater distance between the welding aid and the incandescent filament in order to achieve a light distribution in the incandescent filament which is as homogeneous as possible. This is explained by virtue of the fact that the heat transfer from the outer turns is more noticeable at a higher power owing to the increased temperature gradient.

In this case, FIG. 2A shows the arrangement of the welding aid 2 on the incandescent filament body 4 if the incandescent filament 8 is operated at a power $P_1$. If the abovementioned particularly advantageous ratio of $$0.022 \frac{\text{mm}}{W}$$

is used as the basis for the scaling, a distance of $d_1=0.022 \cdot P_1$ results. This distance amounts to $d_1=0.4$ mm in the likewise abovementioned case of a halogen lamp operated at 18 W.

FIG. 2B likewise shows the arrangement of the welding aid 2 in relation to the incandescent filament body 4. However, this lamp is operated at a lower power $P_2$, i.e. $P_2<P_1$, with the result that the welding aid 2 is arranged at a second distance $d_2$ on the incandescent filament 8. In order to satisfy the ratio $$\frac{d_2}{P_2} = 0.022 \frac{\text{mm}}{W},$$

the distance must be selected to be $d_2<d_1$.

This means, for example, that a lamp which is intended to be operated at a second power $P_2$ of 5 W should only have a distance $d_2$ of 0.11 mm.

The invention discloses a welding aid for an incandescent filament of a lamp or a lamp with such a welding aid, the incandescent filament having an incandescent filament body and at least one incandescent filament end, and the welding aid being arranged at a distance d from the incandescent filament body and being designed to connect the at least one incandescent filament end to a current-conducting mount, wherein the distance d is fixed depending on a power P at which the lamp is operated.

LIST OF REFERENCE SYMBOLS

2 Welding aid
4 Incandescent filament body
8 Incandescent filament
10 Incandescent filament end
12 Current-conducting mount
P Power
d Distance between welding aid and incandescent filament body

The invention claimed is:

1. A welding aid for an incandescent filament of a lamp, the incandescent filament having an incandescent filament body and at least one incandescent filament end, and the welding aid being arranged at a distance (d) from the incandescent filament body and being designed to connect the at least one incandescent filament end to a current-conducting mount, wherein the distance (d) is fixed depending on a power (P) at which the lamp is operated, and wherein the distance (d) and the power (P) satisfy the relationship $$0.018 \leq \frac{d}{P} \leq 0.06 \frac{\text{mm}}{W}.$$

2. The welding aid as claimed in claim 1, wherein the distance (d) and the power (P) satisfy the relationship $$\frac{d}{P} \approx 0.022 \frac{\text{mm}}{W}.$$

3. The welding aid as claimed in claim 2, wherein the incandescent filament is made from tungsten.

4. The welding aid as claimed in claim 3, wherein the welding aid is made from molybdenum.

5. The welding aid as claimed in claim 4, wherein the welding aid is in the form of a tube, strip and/or foil.

6. The welding aid as claimed in claim 1, wherein the lamp is a halogen lamp.

7. A lamp comprising an incandescent filament having an incandescent filament body and at least one incandescent filament end, and a welding aid for fastening the at least one incandescent filament end on a current-conducting mount, the welding aid being arranged at a distance (d) from the incandescent filament body, wherein the distance (d) is fixed depending on a power (P) at which the lamp is operated, and wherein the distance (d) and the power (P) satisfy the relationship $$0.018 \leq \frac{d}{P} \leq 0.06 \frac{\text{mm}}{W}.$$

8. The lamp as claimed in claim 7, wherein the distance (d) and the power (P) satisfy the relationship $$\frac{d}{P} \approx 0.022 \frac{\text{mm}}{W}.$$

9. The lamp as claimed in claim 7, wherein the lamp is a halogen lamp.

10. The welding aid as claimed in claim 1, wherein the incandescent filament is made from tungsten.

11. The welding aid as claimed in claim 1, wherein the welding aid is made from molybdenum.

12. The welding aid as claimed in claim 1, wherein the welding aid is in the form of a tube, strip and/or foil.

* * * * *

UNITED STATES PATENT AND TRADEMARK OFFICE

CERTIFICATE OF CORRECTION

PATENT NO. : 8,212,476 B2
APPLICATION NO. : 12/312624
DATED : July 3, 2012
INVENTOR(S) : Frank Auer It is certified that error appears in the above-identified patent and that said Letters Patent is hereby corrected as shown below:

On the Title Page:
Item (56) U.S. PATENT DOCUMENTS, line 3;
change "Wittmann et al" to --Behr et al.--.

In Column 4, Listing of Claims, lines 8-13;
Claim 1;

change "A welding aid for an incandescent filament of a lamp, the incandescent filament having an incandescent filament body and at least one incandescent filament end, and the welding aid being arranged at a distance (d) from the incandescent filament body and being designed to connect the at least one incandescent filament end to a current-conducting mount"
to --An incandescent filament of a lamp comprising: an incandescent filament body and at least one incandescent filament end, the at least one filament end having a welding aid; wherein the welding aid is arranged at a distance (d) from the incandescent filament body and being designed to connect the at least one incandescent filament end to a current-conducting mount;--.

In Column 4, line 19;
change "and wherein the distance (d) and the power (P) satisfy the relationship
$0.018 \leq d/P \leq 0.06$ mm/W"
to --such that the distance (d) and the power (P) satisfy the relationship
$0.018 \leq d/P \leq 0.06$ mm/W--.

In Column 4, lines 42-48;
Claim 7;
change "and wherein the distance (d) and the power (P) satsify the relationship
$0.018 \leq d/P \leq 0.06$ mm/W"
to --such that the distance (d) and the power (P) satisfy the relationship
$0.018 \leq d/P \leq 0.06$ mm/W--.

Signed and Sealed this
First Day of January, 2013

David J. Kappos

David J. Kappos
*Director of the United States Patent and Trademark Office*